United States Patent [19]

Ben-David

[11] Patent Number: 4,881,758

[45] Date of Patent: Nov. 21, 1989

[54] PARKED VEHICLE LOCATING AID

[76] Inventor: David Ben-David, 6770 Indian Creek Dr., Miami Beach, Fla. 33141

[21] Appl. No.: 303,901

[22] Filed: Jan. 30, 1989

[51] Int. Cl.[4] ..... B42D 15/00

[52] U.S. Cl. ..... 283/102; 283/100; 283/23; 283/48.1

[58] Field of Search ..... 283/100, 70, 23, 102, 283/48 R, 35–37, 39, 41; 40/124.1

[56] References Cited

U.S. PATENT DOCUMENTS 1,917,720 11/1933 Jorgenson et al. ..... 283/100
4,241,943 12/1980 Malinovitz ..... 283/102
4,258,491 3/1981 Ernst et al. ..... 40/525

FOREIGN PATENT DOCUMENTS 518644 4/1940 United Kingdom ..... 283/81

*Primary Examiner*—Paul A. Bell
*Assistant Examiner*—Thomas Hamill, Jr.
*Attorney, Agent, or Firm*—Mitchell P. Novick

[57] ABSTRACT

A vehicle location aid for use with a parking lot divided into areas comprising a disposable card containing unique designations for each parking lot area. The vehicle's driver records the area in which a vehicle is parked by marking, punching out, or removing a removable coating off the portion of the card containing the appropriate designation. Also, the vehicle location aid may contain the date and time of the vehicle's arrival and departure, advertising information, or the other desired information.

6 Claims, 1 Drawing Sheet

Mark•A•Space
Lot Number
1 2 3 4 5
Floor Number
1st 2nd 3rd 4th 5th
6th 7th 8th 9th 10th
Ramp Number
A B C D E F G H
I J K L M N O P
1
10
11
12
13

Mark•A•Space
Scratch off the lot #
1 2 3 4 5
Scratch off floor number
1st 2nd 3rd 4th 5th
6th 7th 8th 9th 10th
Scratch off ramp number
A B C D E F G H
I J K L M N O P
1
10
11
12
13
20

TIME OUT
TIME IN
1
30

PARKED VEHICLE LOCATING AID

BACKGROUND OF THE INVENTION

1. Field of the Invention

This invention relates to devices for recording the location of stored objects and, more specifically, to aids for locating parked vehicles in a parking lot and/or parking garages.

2. Description of the Prior Art

It is well known that drivers often must park their vehicles in large parking lots or garages (hereinafter collectively referred to as "parking lots") at places such as shopping malls, airports, sporting arenas, and amusement parks. It may be very difficult for the drivers to remember the exact location of their vehicle in large parking lots. Drivers often try to remember the location of their cars by noting and recalling positions of objects and landmarks near their vehicles, such as posts, signs, trees, or buildings. This method is haphazard: the drivers may forget the landmarks or not be able to find them. Consequently, the drivers may spend much time and effort just locating their vehicles. The problem may be compounded if the drivers are laden with packages or are accompanied by small children.

To help alleviate the difficulty of locating vehicles in large parking lots, many parking lots are systematically divided into areas by level (if applicable), section, and subsection. Each level, section, or subsection is designated by a symbol, number, and/or letter of the alphabet. Each area is designated by a unique combination of symbols, numbers, and/or letters. Neighboring areas may have designations that are logically related to each other. For example, "Blue A 2" may designate a section next to "Blue A 3" and "Blue B 2". Thus, a driver may take advantage of this logical pattern when locating his parked vehicle.

For this method to help the driver, however, the drivers must still remember the designation of the specific area in which their vehicles are parked. Drivers may trust their memory or jot down the designation on some scrap of paper. Nevertheless, the drivers often forget the designation or lose the paper on which the designation was written. In such cases, the drivers must once again spend much time and effort locating their vehicles.

Prior art discloses methods for recording information regarding arrival and departure of a vehicle in a parking area. For example, U.S. Pat. No. 4,241,943 (Malinovitz) discloses a disposable parking card having month, day, and expiration time which is adapted to be hung securely in a vehicle's window. Also, U.S. Pat. No. 4,240,649 (Weber) discloses a disposable parking card having month, day, and hour indicia. However, these patents and other prior art do not address the need of aiding a driver in locating his parked vehicle after he has left the vehicle's location.

SUMMARY OF THE INVENTION

A primary object of this invention is a vehicle locating aid to help a driver recall the exact location of his vehicle in a parking lot.

Another object of this invention of a vehicle locating aid that simplifies the process, and helps insure the accuracy, of recording the exact location of a vehicle in a parking lot.

Another object of this invention is a vehicle locating aid that can be produced economically enough to be disposable.

Another object of this invention is a vehicle locating aid that may contain advertisements and/or other desired information.

In short, this invention comprises a card customized to a specified parking lot. The card contains the designations for all the areas in a parking lot. The driver selects the designation for the specific area in which his vehicle is located is indicated on the card at the time when the vehicle is parked.

DESCRIPTION OF PREFERRED EMBODIMENT

Figures 1, 2, 3:
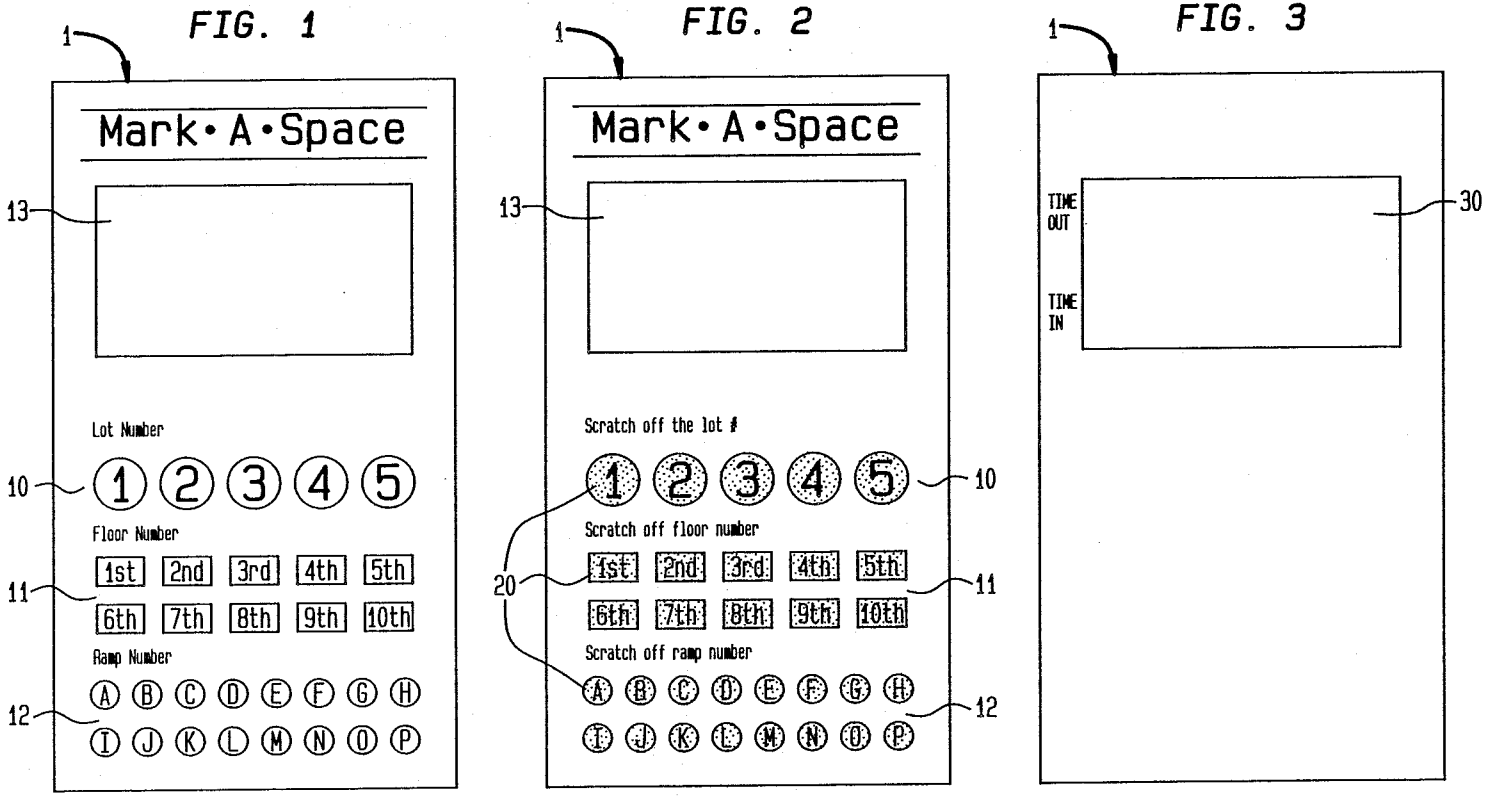
FIG. 1 is a front view of a vehicle location aid for a specific parking lot which is divided into areas by lot, floor, and ramp.
FIG. 2 is a front view of the vehicle location aid shown in FIG. 1 on which a removable coating covers portions containing the lot, floor, and ramp information.
FIG. 3 is a back view of the vehicle location aid shown in FIG. 1.

In the preferred embodiment, the parked vehicle locating aid for a specific parking lot comprises a card 1 on the front of which are recorded, preferably by a printing process, all the symbols, numbers, letters, and other indicia used in designating the various areas of that parking lot. The card 1 is preferably made from an economical paper or plastic composition; thus, the card may be disposed of after a single use.

The positions, sizes, and colors of the indicia on the card 1 are chosen to maximize the aesthetic appearance of the card, but more importantly, to minimize the possibility of the inaccurate recording of a specific vehicle's location or the misinterpretation of the information recorded on the card 1.

Each area of the parking lot corresponds to a unique designation on the card 1 comprised of one lot number 10, one floor number 11, and one ramp letter 12.

The card 1 allows for permanently recording the unique designation of any area of the parking lot. Preferably, this recording may be accomplished in one of three (3) preferred methods. The card 1 may be designed to accommodate one or more of these methods. First, the portions of the card 1 containing the indicia may have a surface that is markable with a writing instrument, such as a ball point pen or a felt tip marker. Second, the portions of the card 1 containing the indicia may be removable by punching out by using an appropriate punching device, such as a pointed object; these portions of the card 1 are preferably surrounded by perforations to facilitate their removal. Third, the portions of the card 1 containing the indicia may be covered with a removable layer 20; this layer 20 may be removable by scratching off or by rupturing. These methods are all well known to those persons skilled in the art.

On the back of the card 1 is a space 30 for recording the time of the vehicle's arrival and departure in the parking lot.

In use, a vehicle enters the parking lot. Next, a ticket distribution machine or a parking lot attendant records the vehicle's arrival data and time in the space 30 on the back of the card 1 by either a machine time stamp or by writing in the time. These time recording methods are both well known to those persons skilled in the art. Then, the card 1 is given to the driver of the vehicle.

After the driver parks the vehicle, he determines the set of lot number 10, floor number 11, and ramp number 12 which uniquely corresponds to the area where the vehicle has been parked. These indicia are then permanently recorded on the card 1 by marking, punching, scratching, or rupturing (whichever method applies). The driver will carry the card 1 with him. When the driver desires to locate the parked vehicle, he examines the card 1 to recall in which parking lot area the vehicle is parked. The driver may then proceed directly to that area.

Upon exiting the parking lot, the driver hands the card 1 to the parking lot attendant. The attendant calculates the parking charge, and the driver pays that charge. The attendant then marks the card 1 as "paid". Because the card is designed as disposable and not to be reused by the parking lot, the attendant returns the card 1 to the driver. The combination of recording both the date and time of the vehicle's arrival and marking the card as "paid" prevents drivers from using the card again in the future. The driver may then dispose of the card 1 if he so desires or save the card 1 as a receipt.

The card 1 may contain space 13 for advertisements or other desired information. Furthermore, the driver may retain the card 1, which then serves as a momento from the shopping mall, amusement park, or other place were the parking lot is located.

Although this invention has been described with a certain degree of particularity, it is to be understood that the present disclosure has been made only by way of illustration and that numerous changes in the details of construction and arrangement of parts may be resorted to without departing from the spirit and scope of this invention.

I claim:

1. A vehicle location aid for use with (a) a parking lot divided into a plurality of areas, each said area having a corresponding unique area designation, and (b) a vehicle located in one of said areas, said location aid comprising:

a card comprising a printed section, said section having a series of indicia, each member of said series corresponding uniquely to one of said area designations; and recording means for recording the member corresponding uniquely to the designation of the area in which said vehicle is located.

2. A vehicle location aid as described in claim 1 in which said recording means comprise:

a surface on said section being markable with a writing instrument.

3. A vehicle location aid as described in claim 1 in which said recording means comprise:

means for said members to be individually punchably removable.

4. A vehicle location aid as described in claim 1 in which said recording means comprise:

a removable layer covering said section.

5. A vehicle location aid as described in claim 1 in which said card further comprises a section for information other than said indicia.

6. A vehicle location aid for use with (a) a parking lot divided into a plurality of areas, each said area having a corresponding unique area designation; each said area divided into a plurality of subareas, each said subarea having a corresponding unique subarea designation, and (b) a vehicle located in one of said subareas, said location aid comprising:

a card comprising a plurality of printed sections;

one such section being an area section having an area series of indicia, each area member of said area series corresponding uniquely to one of said area designations;

another such section being a subarea section having a subarea series of indicia, each subarea member of said subarea series corresponding uniquely to one of said subareas designations; and recording means for recording the area member and the subarea member which, as a set, correspond uniquely to the designation of the area in which said vehicle is located.

* * * * *